US005746339A

United States Patent [19]

Petre et al.

[11] Patent Number: 5,746,339

[45] Date of Patent: May 5, 1998

[54] PLASTICS BOTTLE THAT, WHEN EMPTY, IS COLLAPSIBLE BY AXIAL COMPRESSION

[75] Inventors: Jean-Marie Petre, Bon-En-Chablais; Isabelle Fandeux, Evian-Les-Bains, both of France

[73] Assignee: Societe Anonyme Des Eaux Minerales D'Evian, Evian-Les-Bains, France

[21] Appl. No.: 716,387

[22] PCT Filed: Jan. 22, 1996

[86] PCT No.: PCT/FR96/00097

§ 371 Date: Sep. 19, 1996

§ 102(e) Date: Sep. 19, 1996

[87] PCT Pub. No.: WO96/22918

PCT Pub. Date: Aug. 1, 1996

[30] Foreign Application Priority Data

Jan. 23, 1995 [FR] France ..... 95 00711

[51] Int. Cl.[6] ..... B65D 1/02; B65D 1/40; B65D 23/00

[52] U.S. Cl. ..... 215/383; 215/382; 215/900; 220/666; 220/672; 220/907

[58] Field of Search ..... 215/383, 900, 215/382; 220/666, 669, 6, 907, 972

[56] References Cited

U.S. PATENT DOCUMENTS

| | | | |
|---|---|---|---|
| 2,720,998 | 10/1955 | Potter | 220/6 |
| 3,083,877 | 4/1963 | Gash | 220/666 X |
| 3,872,994 | 3/1975 | Hyde | 215/900 X |
| 4,316,551 | 2/1982 | Belokin, Jr. | 215/900 X |
| 5,174,458 | 12/1992 | Segati | 220/669 X |
| 5,201,438 | 4/1993 | Norwood | 215/900 X |
| 5,632,397 | 5/1997 | Fandeaux et al. | 215/900 X |

FOREIGN PATENT DOCUMENTS

| | | |
|---|---|---|
| 0644121 | 3/1995 | European Pat. Off. . |
| 2259754 | 8/1975 | France . |
| WO 94/05555 | 3/1994 | WIPO . |

*Primary Examiner*—Sue A. Weaver

*Attorney, Agent, or Firm*—Bell Seltzer Intellectual Property Law Group of Alston & Bird LLP

[57] ABSTRACT

A plastics material bottle is collapsible by applying axial compression, the bottle comprising a cylindrical body having a polygonal cross-section, e.g. a section that is substantially square or rectangular with rounded corners (18), the body being formed with transverse fluting grooves (14) which include fold starters (16) situated in the immediate vicinity of the above-mentioned rounded corners (18). The invention is particularly applicable to bottles for containing beverages such as mineral water, for example.

14 Claims, 1 Drawing Sheet

PLASTICS BOTTLE THAT, WHEN EMPTY, IS COLLAPSIBLE BY AXIAL COMPRESSION

FIELD OF THE INVENTION

The invention relates to a plastics material bottle intended, in particular, to contain a beverage such as mineral water, for example, and which is collapsible when empty by applying axial compression so as to reduce it to a residue of small volume.

BACKGROUND OF THE INVENTION

In French patent application No. 94 01811 the Applicant has also proposed bottles of that type in which the cylindrical body is formed with transverse V-section fluting having local outwardly-directed projections constituting fold starters that enable the open and empty bottle to be collapsed more or less completely when an axial compression force of less than 10 daN is applied thereto, such bottles nevertheless presenting good strength in axial compression when they are full and closed, thereby enabling them to be transported in the form of palletized loads and stacked loads.

The bottles described in the above-specified prior application are of circular cross-section, and the fold starters are uniformly distributed in the fluting and are angularly offset by $\pi/n$ from one fluting groove to the next, where n is the number of fold starters per fluting groove, and generally lies in the range 3 to 20.

Those dispositions are not directly applicable to cylindrical bottles of substantially polygonal cross-section in which the edges of the wall of the bottle constitute zones of greater stiffness, such that much greater axial compression force needs to be applied to the empty and open bottle in order to collapse it, with the edges of the wall also impeding uniform or regular collapsing of the bottle.

SUMMARY OF THE INVENTION

An aim of the invention is to provide a solution to this problem that is simple, effective, and cheap.

An object of the invention is to provide bottles of plastics material that are generally cylindrical in shape being of substantially polygonal cross-section, e.g. rectangular or square, which, when empty and open, are easily collapsed by applying an axial compression force of relatively low value, which are nevertheless transportable when full and closed in stacked and palletized loads, and which are capable of being manufactured by conventional injection blow-molding or extrusion blow-molding techniques.

To this end, the invention provides a plastics material bottle that is collapsible when empty by applying axial compression, the bottle comprising a cylindrical body formed with substantially V-section transverse fluting grooves and with outwardly-projecting fold starters formed locally on the bottoms of the fluting grooves, the bottle being characterized in that the body is of polygonal cross-section with rounded corners and in that the fold starters are formed in the immediate vicinity of the rounded corners of the polygonal section of the body.

The presence of fold starters in the immediate vicinity of the rounded corners of the polygonal section of the body of the bottle promotes and facilitates collapsing thereof (when empty and open) on application of a small axial compression force, by reducing the rigidity (when empty) of the rounded edges of the body of the bottle.

Preferably, the fold starters are angularly offset from one fluting groove to the next, being formed alternately on one side and on the other of the rounded corners of the section of the body.

According to another characteristic of the invention, the number of fold starters per fluting groove is equal to the number of rounded corners in the polygonal section of the body.

In a first embodiment of the invention, the body of the bottle is substantially square in section and there are four fold starters per fluting groove which are formed at 90° intervals relative to one another in each fluting groove.

In another embodiment of the invention, the body of the bottle is substantially rectangular in section, with convex curved sides, i.e. the concave faces of the sides face the inside of the bottle.

Each fold starter may be defined by the intersection of the fluting groove and a circular section cylindrical surface whose axis lies inside the bottle and extends obliquely relative to the axis of the bottle, the fold starter being formed by that portion of said cylindrical surface which projects beyond the face of the fluting groove.

In a variant, each fold starter is defined by the intersection of the fluting groove and a frustoconical surface of circular right section whose axis lies inside the bottle and is substantially parallel to the axis of the bottle or extends obliquely relative thereto, the fold starter being formed by the portion of said frustoconical surface that projects beyond the outside face of the fluting groove.

BRIEF DESCRIPTION OF THE DRAWINGS

The invention will be better understood and other characteristics, details, and advantages thereof will appear more clearly on reading the following description given by way of example and made with reference to the accompanying drawing, in which.

DETAILED DESCRIPTION OF THE DRAWINGS

Figure 1:
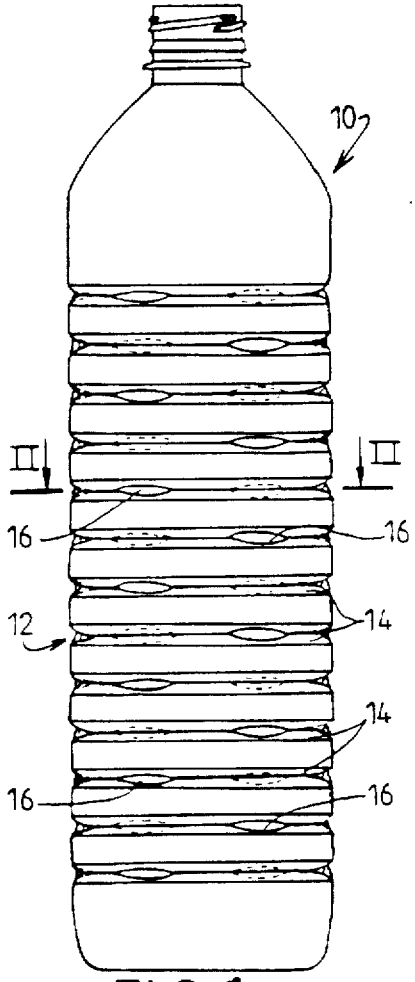
FIG. 1 is a diagrammatic elevation view of a bottle of the invention.
Figure 3:
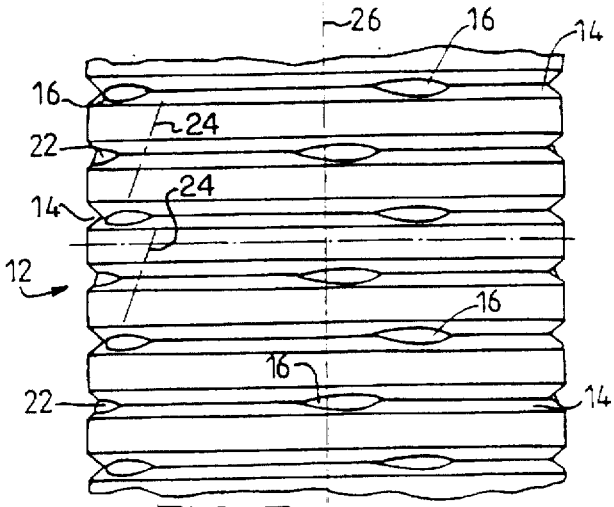
FIG. 3 is an enlarged diagrammatic view of a portion of the FIG. 1 bottle seen from a different angle.
Figure 2:
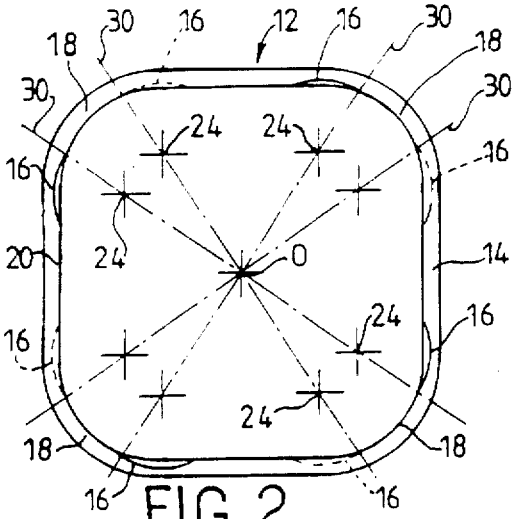
FIG. 2 is an enlarged diagrammatic view in cross-section on line II—II of FIG. 1.

Reference is made initially to FIGS. 1 to 3 which are diagrams showing a first embodiment of the invention in which a bottle 10 made of a plastics material such as PET (poly(ethylene-terephthalate)) comprises a generally cylindrical body 12 of substantially square section formed with transverse fluting 14 in which the grooves are of substantially V-shaped section, and include fold starters 16 projecting towards the outside of the bottle and enabling the bottle to be more or less completely collapsed (when open and empty) on being subjected to an axial compression force of about 10 daN.

There are four fold starters 16 per fluting groove in the example shown and they are situated in the immediate vicinity of the rounded corners 18 of the cross-section of the body 12, being angularly offset from one fluting groove 14 to the next, with the fold starters 16 in one groove 14 being represented by solid lines in FIG. 2 while the fold starters of the groove immediately below being represented by dashed lines.

As can be seen in FIG. 2, the circular arc defining the outline of a fold starter 16 in the plane of FIG. 2 (section plane II—II in FIG. 1) connects with the circular arc defining a rounded corner 18 of the section of the body 12 substantially at the point where the circular arc of the rounded corner 18 connects with the corresponding rectilinear side 20 of the section of the body 12 in the plane of FIG. 2, said rectilinear side 20 corresponding to the bottom of the groove 14.

Thus, all of the fold starters 16 are formed in the immediate vicinity of portions defining rounded edges of the body 12, and this is done without significantly encroaching on the rounded shapes of said edges.

The angular offset between the fold starters 16 in one fluting groove and the next is such that when a fold starter 16 in a groove lies on one side of a rounded corner 18 of the section of the body 12, then the corresponding fold starter 16 of the groove immediately above or below is on the other side of the rounded corner 18, as can be seen clearly from the drawing of FIG. 2. In other words, when a fold starter 16 in a given fluting groove is on one of the plane faces of the body of the bottle, then the corresponding fold starters of the grooves immediately above and below are on the other face of the body of the bottle.

In the embodiment of FIGS. 1 to 3, the fold starters 16 are generated by cylindrical surfaces 22 of circular right section whose axes 24 lie inside the bottle and are obliquely inclined relative to the axis 26 of the bottle, the fold starters 16 being formed by the portions of said cylindrical surfaces 22 which project from the outside faces of the fluting grooves 14.

The axes of the cylindrical surfaces 22 are inclined at an angle lying in the range about 10° to about 30° or 35°, and preferably at about 20° relative to the axis of the bottle.

The outlines of the fold starters 16 in an elevation view of the bottle show where the cylindrical surfaces 22 intersect with the V-section fluting grooves 14, and they are therefore substantially elliptical, as can be seen in FIGS. 1 and 3.

Figure 4:
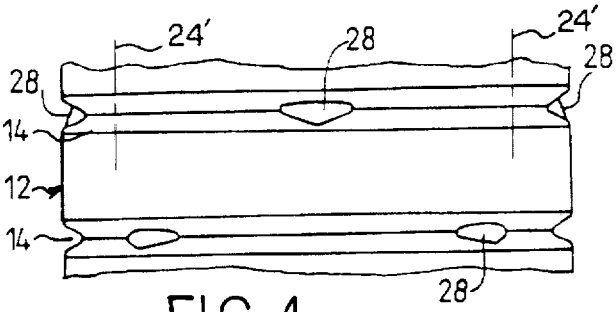
FIG. 4 is a fragmentary view corresponding to FIG. 3 and showing a variant.

In a variant shown diagrammatically in FIG. 4, the fold starters are formed by frustoconical surfaces 28 of circular right section whose axes 24' are situated inside the bottle and may be parallel to the axis 26 of the bottle or may be slightly inclined obliquely relative to said axis. In which case, the outlines of the fold starters in an elevation view of the bottle are defined by the intersections between the frustoconical surfaces 28 and the V-section fluting grooves 14 and are substantially in the form of triangles having curved sides, as can be seen in FIG. 4.

In both cases, the lines following the apexes of the fold starters 16, i.e. the generator lines of the surfaces 22 or 28 and which are defined by the intersections between the fold starters and the midplanes of symmetry of said fold starters and including the axis of the bottle, are rectilinear and inclined at an angle of about 10° to about 30° or 35° relative to the axis of the bottle, with the presently preferred value for said angle being about 20°. The vertex lines connect with the walls of the fluting grooves via concave rounded portions of very small radius of curvature (i.e. portions whose concave sides face towards the outside of the bottle).

In general, the angle of inclination of the vertex lines of the fold starters relative to the axis of the bottle must be greater than about 10° and less than half the angle of divergence of the fluting grooves 14 (i.e. the angle at the apex of the V-shaped section thereof), said angle of divergence being about 70° in the examples shown in the drawings. The angle of inclination of the vertex lines of the fold starters also depends on the depth of the fluting groove. In all cases, this angle is such that the component of an axial compression force exerted on the bottle (when empty and open) along a perpendicular to the vertex line of a fold starter serves to cause the fold starter to fold towards the outside of the bottle.

The fold starters 16 formed in the fluting grooves 14 may be completely defined as follows:

- their outwardly-projecting shape in the fluting grooves 14 is determined by the cylindrical or frustoconical shape of the surface of revolution that generates them; and
- the positions of the axes of said cylindrical or frustoconical surfaces inside the bottle are defined from the angular extent of each fold starter in a transverse plane passing via the middle of the corresponding fluting groove (i.e. the plane of FIG. 2) and by the radial projection formed by each fold starter 16 in said plane on the bottom 20 of the fluting groove 14, and also by the position of the point where the fold starter 16 connects with the adjacent rounded corner of the section of the body 12.

By way of example, the following initial conditions may be fixed:

- each fold starter 16 has one of its ends connecting with one of the ends of a rounded corner 18 such that the axes 24 of the cylindrical or frustoconical surfaces defining the fold starters intersect the plane of FIG. 2 at points situated on lines 30 passing through the ends of the rounded corners and the center O of the section of the body 12 of the bottle;
- the angular extent $\epsilon$ of a fold starter 16 about the axis of the bottle is fixed at a value such that the developed length of the fold starter (or the length of the outline of the fold starter in the plane of FIG. 2) lies in the range 0.03 times to 0.1 times the perimeter of the bottle in said plane;
- said angular extent or developed length determines the position of the other end of the fold starter on the bottom 20 of the fluting groove (the first end lying on one of the above-specified lines 30); and
- the maximum radial projection of the fold starter 16 from the bottom 20 of the fluting groove 14 in the plane of FIG. 2 is about half the depth of the groove and determines the radius of said fold starter about the axis 24, and thus the position of the point where the axis 24 intersects the corresponding line 30.

Once the position of said intersection on the line 30 has been determined for a fold starter, the positions of the intersections of the axes 24 for the other fold starters 16 of the same fluting groove 14 are determined by rotations through 90° about the axis of the bottle. The fold starters 16 of the following fluting groves define positions of the intersections of the axes 24 of the corresponding surfaces of revolution with the above-mentioned lines 30 by rotation about the axis of the bottle through an angle that is substantially equal to the angular extent of each above-mentioned rounded corner 18.

In the embodiment of FIGS. 1 to 3, the body of the bottle has a square cross-section with rounded corners and the fold starters are distributed in regular manner within each fluting groove 14, the fold starters 16 all being at 90° from one another about the axis of the bottle.

Figure 5:
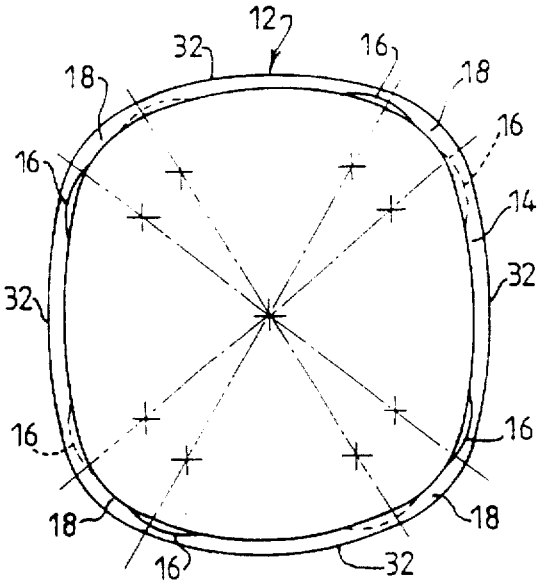
FIG. 5 is a diagrammatic cross-section view of another variant embodiment of the bottle of the invention.

In the embodiment of FIG. 5, the body 12 of the bottle is of substantially rectangular cross-section with rounded corners 18 and with convex curved sides 32. Each fluting groove 14 has four fold starters 16 each of which may be generated, for example, by a frustoconical surface as in the embodiment of FIG. 4, and each of which is formed in the immediate vicinity of a rounded corner 18, in such a manner that the fold starters 16 are distributed around the axis of the bottle in a manner that is no longer uniform. For example, two fold starters 16 adjacent to the ends of a small side of the rectangular section are about 80° apart whereas two fold starters 16 adjacent to the ends of a large side of the rectangular section are about 100° apart, measured relative to the axis of the bottle.

As in the preceding embodiments, the fold starters of two adjacent fluting grooves are angularly offset from one groove to the next by an angle corresponding approximately to the angular extent of each rounded corner 18.

Otherwise, the parameters for defining the fold starters 16 are similar to those described with reference to FIG. 2.

For a bottle having a body of polygonal cross-section other than a square or a rectangle, the number of fold starters per transverse fluting groove is equal to the number of vertices in the polygonal section, and the rules for defining the fold starters are the same as those explained above.

Bottles of the invention can be made by extrusion blow-molding or by injection blow-molding, they can bemade out of PET or out of some other plastics material such as, for example, PVC, a polyolefin or a polyester, a flexible material or a material that is composite, laminated, or "compound".

We claim:

1. A plastics material bottle that is collapsible when empty by applying axial compression in a direction defined by a longitudinal axis of the bottle, the bottle comprising a cylindrical body formed with substantially V-section transverse fluting grooves and with outwardly-projecting fold starters formed locally on the bottoms of the fluting grooves, the body having a generally polygonal cross-section normal to the bottle axis, the polygonal cross-section having rounded corners and the fold starters being formed in the immediate vicinity of the rounded corners of the polygonal cross-section of the body.

2. A bottle according to claim 1, wherein the fold starters in each fluting groove are angularly offset in the circumferential direction from the fold starters in adjacent fluting grooves.

3. A bottle according to claim 2, wherein the angular offset between the fold starters in adjacent fluting grooves is substantially equal to the angular extent of a rounded corner about the axis of the bottle.

4. A bottle according to claim 1 wherein the fold starters are alternately formed on either side of each rounded corner from one fluting groove to the next.

5. A bottle according to claim 1, wherein the number of fold starters per fluting groove is equal to the number of rounded corners in the polygonal cross-section of the body.

6. A bottle according to claim 1, wherein the body is substantially square in cross-section.

7. A bottle according to claim 6, characterized in that there are four fold starters per fluting groove and they are formed at 90° intervals from one another in each fluting groove.

8. A bottle according to claim 1, wherein the body is of substantially rectangular cross-section having convex curved sides, with the concave faces thereof facing towards the inside of the bottle.

9. A bottle according to claim 1, wherein each fold starter is defined by the intersection of the fluting groove and a circular section cylindrical surface whose axis lies inside the bottle and extends obliquely relative to the axis of the bottle, the fold starter being formed by that portion of said cylindrical surface which projects beyond the face of the fluting groove.

10. A bottle according to claim 1, wherein each fold starter is defined by the intersection of the fluting groove and a frustoconical surface of circular right section whose axis lies inside the bottle and is substantially parallel to the axis of the bottle.

11. A bottle according to claim 1, wherein the angular extent of a fold starter about the axis of the bottle is such that the length of the outline of the fold starter in a plane perpendicular to the axis of the bottle lies in the range 0.03 times to 0.1 times the perimeter of the bottle in said plane.

12. A bottle according to claim 1, wherein each fold starter comprises a surface generated by revolution of a vertex line about the axis of the bottle, wherein the vertex line extends in a plane of symmetry including the axis of the bottle and is inclined relative to said axis by an angle lying in the range about 10° to about 35°.

13. A bottle according claim 1, wherein the maximum value of the radial projection formed by a fold starter from the bottom of the corresponding fluting groove in a mid transverse plane passing through the middle of the fluting groove is about half the depth of the fluting groove.

14. A bottle according to claim 1, wherein each fold starter is defined by the intersection of the fluting groove and a frustoconical surface of circular right section whose axis lies inside the bottle and extends obliquely relative to the axis of the bottle.

* * * * *